US005233893A

United States Patent [19]

Schmidt

[11] Patent Number: 5,233,893

[45] Date of Patent: Aug. 10, 1993

[54] SAFETY PLIER TYPE TOGGLE WRENCH

[76] Inventor: Marion E. Schmidt, 3012 Washington-Jackson Rd., Eaton, Ohio 45320

[21] Appl. No.: 991,359

[22] Filed: Dec. 15, 1992

Related U.S. Application Data

[63] Continuation-in-part of Ser. No. 853,836, Mar. 19, 1992, abandoned, which is a continuation-in-part of Ser. No. 621,610, Nov. 30, 1990, abandoned.

[51] Int. Cl.[5] ..... B25B 7/12

[52] U.S. Cl. ..... 81/368; 81/370

[58] Field of Search ..... 81/367-383.5

*Primary Examiner*—D. S. Meislin

*Attorney, Agent, or Firm*—Louis E. Hay

[57] ABSTRACT

Plier type toggle wrenches may be divided into two broad types: the more common type in which the tool is caused to remain in its gripping mode when a portion of the toggle crosses over, or beyond the toggle center line; and, the less common type in which the toggle does not cross the toggle center line when the tool is in the gripping mode. The second type will not remain in the gripping mode unless the user applies continuous hand pressure, or, a releasable latching means is used to prevent the tool from opening. The present invention relates to the second type of toggle wrenches, and, in the preferred species of the invention, the latching means is in the nature of a sear, the elements of which engage in locked position when the tool is gripping a workpiece. The sear cannot be released to permit the wrench from disengaging the workpiece until the user again squeezes the handles of the tool and applies sufficient additional squeezing pressure while simultaneously, and with the same hand, releases a safety which would otherwise prevent the sear from disengaging. When the sear is disengaged, the user, by relaxing the squeezing pressure on the handles of the tool, may gradually permit the tool to assume its free unloaded position, and thereby prevent the tool from flying open and possibly causing an injury.

24 Claims, 3 Drawing Sheets

SAFETY PLIER TYPE TOGGLE WRENCH

This is a continuation in part application of co-pending application Ser. No. 853,836 filed Mar. 19, 1992, now abandoned, which in turn is a continuation in part application of abandoned application Ser. No. 621,610 filed Nov. 30, 1990, now abandoned.

BACKGROUND OF THE INVENTION

Plier type toggle wrenches have long been utilized in the prior art. Most of these wrenches have commonly employed a toggle mechanism so designed as to pass over a dead center position for locking a pair of gripping jaws in clamped engagement with a workpiece. Such wrenches normally include an adjusting mechanism to adjust the distance between the gripping jaws, thereby permitting the jaws to grip workpieces of different sizes and shapes. The adjusting mechanism further serves as an adjustment of the gripping force exerted by the jaws.

These prior art wrenches, which are locked onto the workpiece when an element of the toggle mechanism passes beyond or over toggle dead center, are released or opened either by pulling apart the operating handles manually, or by actuating a control lever so as to break the toggle apart. When maximum mechanical advantage of the toggle is employed to clamp a workpiece between a pair of gripping jaws, it is very likely to have the handles come apart very rapidly and with considerable force when the toggle is broken. A large toggle wrench of this type must be treated with respect as a dangerous tool because of the sudden release of energy. The casual user of such a toggle wrench can easily be struck in an eye or break a tooth when the wrench flies open upon release.

It is also known in the art to employ wrenches having toggle mechanisms which are adjustable so that the elbow of the toggle does not pass over or beyond the toggle center line. Such wrenches should be adjusted to exert the maximum gripping force just prior to the elbow of the toggle reaching the toggle center line.

The best known prior art toggle wrench of this type is Petersen, U.S. Pat. No. 2,853,910 Latch Means For Plier Type Toggle Wrench. This patent teaches a wrench which includes a toggle mechanism comprising an actuating lever 21 and a link 23. A latch bar 30 is provided and is pivotally mounted to the actuating lever 21. The latch bar 30 includes a hook-shaped latch 33 which, when engaged with a latch engaging lip 36 on the link 23, securely latches the jaws 11 and 13 in a gripping position. The latch bar 30 is further provided with a finger engaging portion 37 which serves, when depressed, to release the toggle mechanism and permits the jaws 11 and 13 to open under the action of a tension spring 16. This wrench has been found to be very difficult to manipulate because the finger engaging portion 37 is not positioned to be in an easily accessible location. For this reason, most operators must use both hands to operate the wrench, one for holding the tool, and the other for operating the latch.

There is a need for an improved plier type toggle wrench which includes a toggle mechanism which operates to close the jaws of the wrench in a clamping position just prior to reaching the toggle dead center position and which includes a readily accessible release button positioned so as to enable a user to control the tool easily with one hand.

SUMMARY OF THE INVENTION

Most of the commonly used plier type toggle wrenches have certain principal elements which are substantially the same in form and function. Such elements include, but are not limited to, an elongated main handle which has a fixed gripping jaw at one end and an adjusting screw at the other end; an opposing movable jaw which is pivotally mounted on the main handle and is positioned to form an adjustable opening between the jaws; an actuating handle having one end pivotally joined at one end to the movable jaw; a toggle link having one end pivotally joined to the actuating handle and with the opposing end bearing against the adjusting screw in the main handle; and a tension spring biasing the toggle wrench to its open position.

In the type of toggle wrench to which the present invention relates, the primary object is to provide a wrench which is safe under all conditions. One of the requirements is for the wrench to latch automatically. Another requirement is that the wrench is not to become unlatched until the user has a firm grip on the handles of the wrench to enable a gradual release of the energy stored in the wrench.

The present toggle wrench has a releasable sear acting between the actuating handle and the toggle link. One element of the sear which is directly associated with the actuating handle has a biasing means to automatically bias the sear element to its latched position when the wrench approaches its closed position.

Another element is an override which, when activated, neutralizes the biasing means which biases the sear to latch, while at the same time initiating another biasing force which biases the engaged sear to unlatch when additional squeezing pressure is simultaneously applied to the handles of the wrench. The override may be controlled by a push button extending through a hole in the actuating handle where it is positioned to be within the single hand grasp of the user.

After the sear releases, the user relaxes his hand and the built-up energy stored in the wrench dissipates. Since the user prevents instantaneous release of the stored energy in the toggle wrench, the wrench can cause no harm to the user.

In another species of the present invention, the mating contact surfaces of the latch also act as a sear. A safety override is provided. Pressing the button extending through the actuating handle increases the bias of a tension spring which in turn releases the sear when the user squeezes the handle with sufficient force to reduce the pressure holding the sear elements together. All species of the present invention may be provided with suitable stop means to prevent the elbow of the toggle from going over the toggle center line.

DETAILED DESCRIPTION OF THE PREFERRED EMBODIMENT

Figure 1:
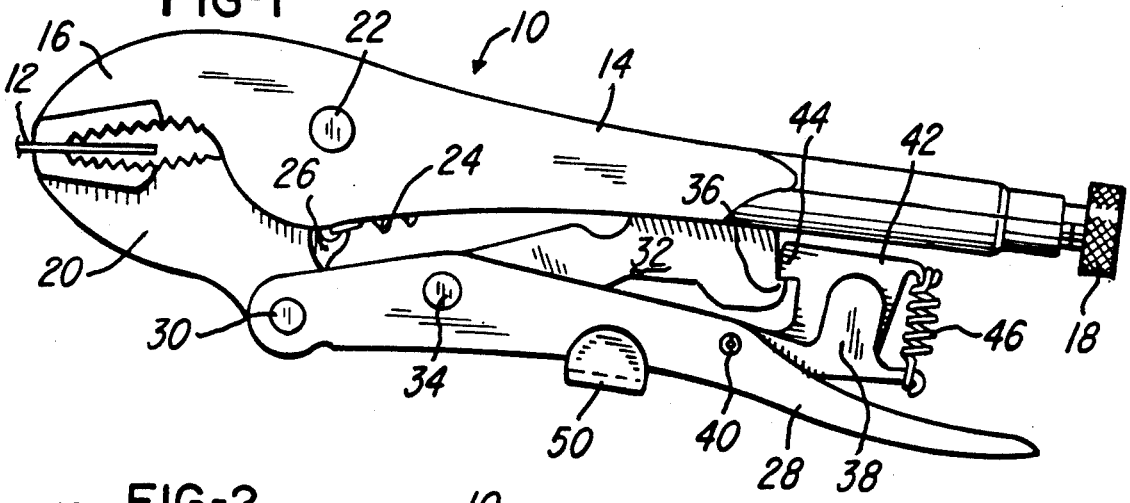
FIG. 1 is a front elevation of the plier type toggle wrench of the present invention, gripping a workpiece and latched in the gripping mode.
Figure 2:
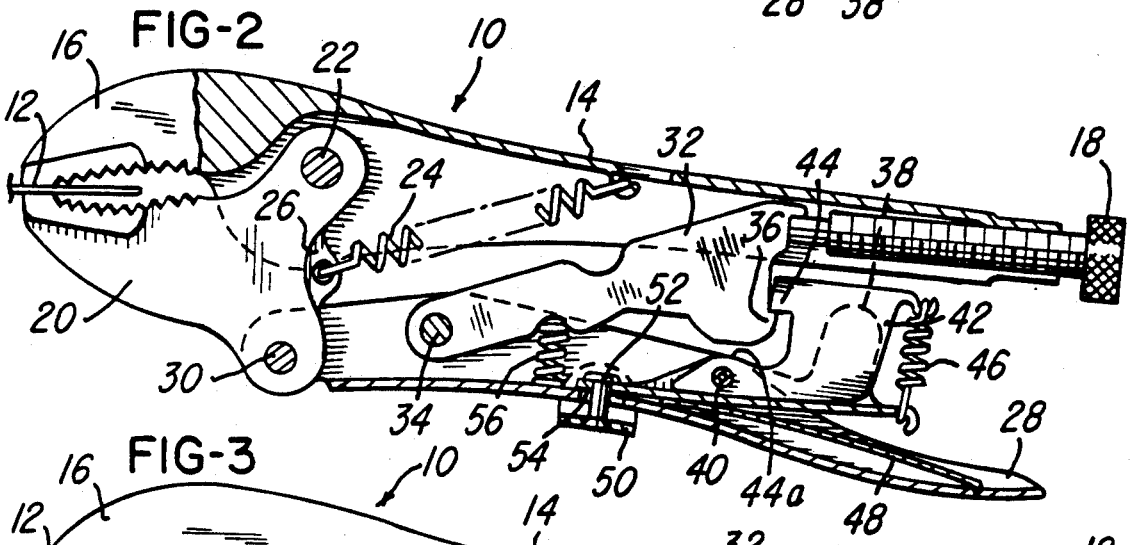
FIG. 2 is comparable to FIG. 1, partially in section to depict internal elements of the wrench.
Figure 3:
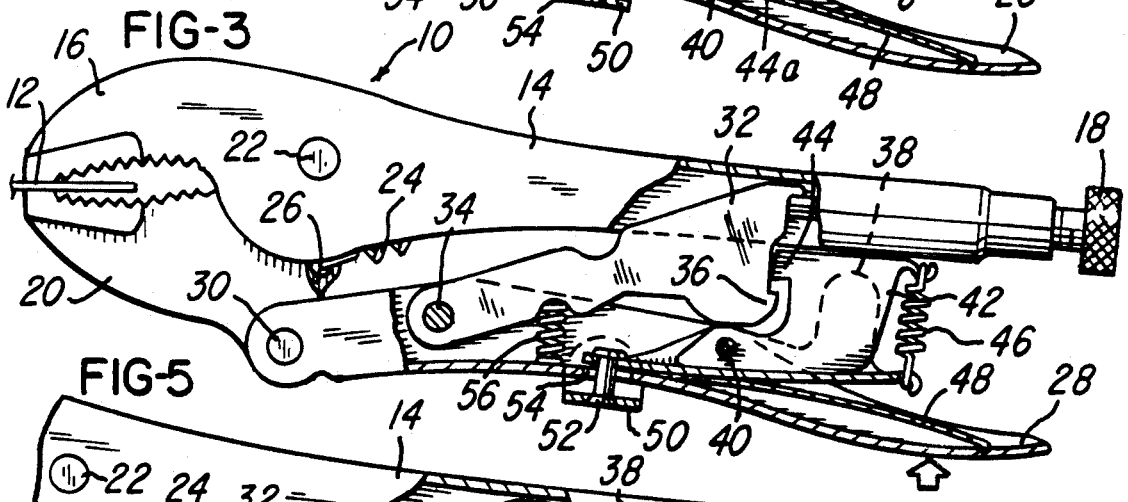
FIG. 3 is comparable to FIG. 2 with the actuating lever further depressed to depict a stop formed to prevent the toggle link from going beyond the toggle dead center.

The safety plier type toggle wrench of the present invention is designated by numeral 10, and is shown in FIGS. 1–3 to be in gripping or clamping engagement with a workpiece 12 which does not comprise a portion of the present invention.

The wrench 10 includes a main handle having a first integral fixed jaw 16 at the front end thereof, and an elongated adjusting screw 18 at the rear end thereof. The adjusting screw 18 is in threaded engagement at the rear of the handle, and moves on the longitudinal axis of the handle.

A second, and opposing jaw 20, is pivotally mounted on the main handle 14 by means of a pivot pin 22. The second jaw is pivoted at a point where it will pivot toward or away from the first jaw to vary the opening between the two jaws. The inner adjacent surfaces of the two jaws may be contoured to any desired shape, and may or may not include serrated teeth as shown.

As best seen in FIGS. 2 and 3, an elongated tension spring 24 has one end connected to a pierced hook in the main handle 14 and the opposite end thereof connected to an ear 26 on jaw 20. The tension spring 24 biases the movable jaw 20 away from the fixed jaw 16.

An actuating handle 28 is pivotally joined to a protuberance on jaw 20 by means of a pivot pin 30.

A toggle link 32 has a first end which is pivotally joined near the front end of the actuating handle 28 by means of pivot pin 34. The rear, or second end, of the toggle link 32 extends to the rear of the toggle wrench where it abuts against the inner end of the adjusting screw 18 as depicted in all figures. It is thus noted that the toggle link bears and interacts with both the main handle 10 and the actuating handle 28. The toggle dead center occurs when the center of pivot pins 30 and 34, and the point of abutment between the free end of the toggle link 32 and the adjusting screw 18 are on a common center line. If the pivot pin 34 inwardly crosses this line, the toggle is beyond dead center.

Figure 6:
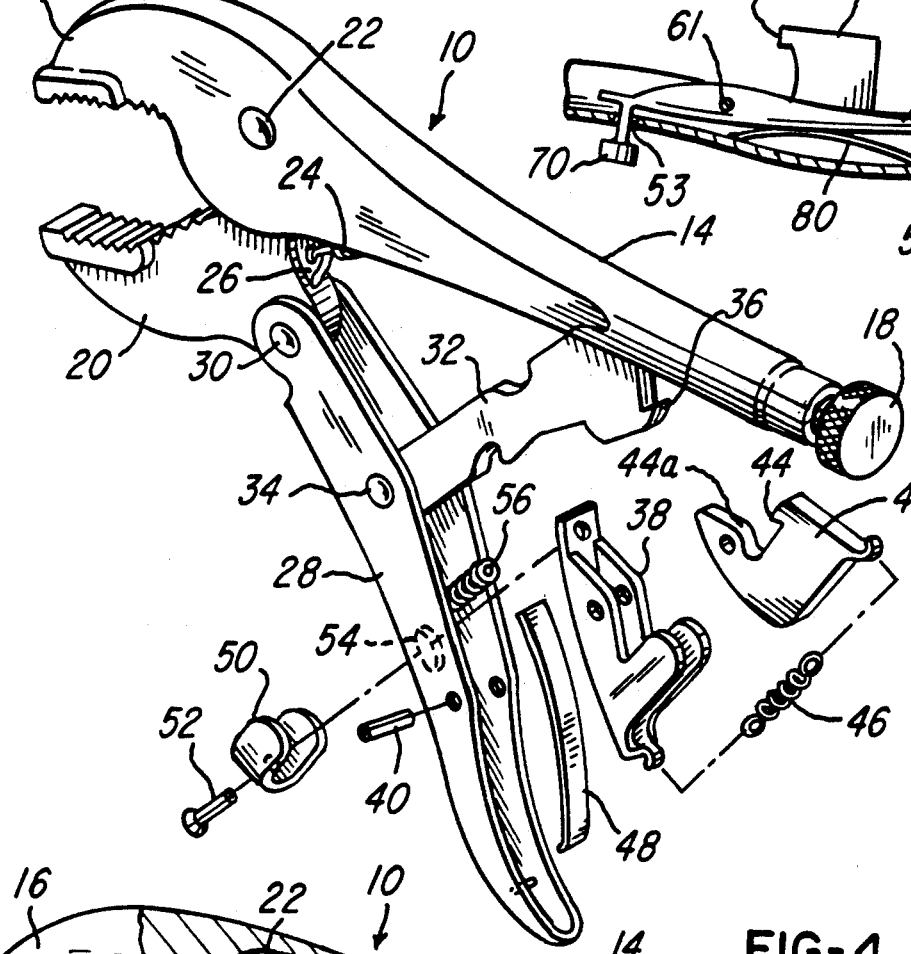
FIG. 6 is an exploded perspective of the toggle wrench depicting the working elements of the wrench.

If the pivot pin 34 is outside the toggle center line described above, then the toggle wrench cannot stay locked onto a workpiece without a latching device. If the pivot pin 34 is outside the toggle centerline, and there is no squeezing action applied to the handles by the user, then the tension spring 24 will open the actuating handle in relationship to the main handle as depicted in FIG. 6. The jaws of the wrench will also be in their fully open relationship.

The adjusting screw 18 controls the jaw opening and is adjusted to the position where the jaws will apply the desired gripping pressure on the workpiece when the wrench is in its latched position.

Figure 5:
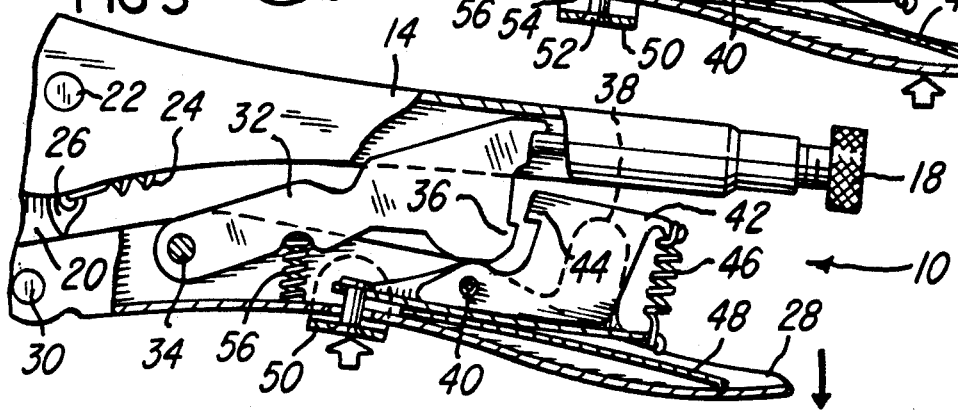
FIG. 5 is a fragmentary elevation comparable to FIG. 4 and depicting the actuating button depressed, the toggle link against the stop, and the sear disengaged to permit the toggle wrench to open.

The only latch or sear element on the toggle link 32 is first sear element 36 which is best seen on FIGS. 3,5, and 6. The sear element is formed at the rear or free end of the toggle link as depicted. All remaining elements or components necessary for the operations of latching and unlatching the wrench are associated with the actuating handle 28.

An actuating lever 38, the shape of which is best seen in perspective in FIG. 6 and in front elevation in FIG. 1, is pivotally joined to the actuating handle 28 by pivot pin 40. The two vertical side elements of the lever are in spaced-apart relationship to slidably receive the sear block 42. The sear block 42 is also pivotally joined within the lever 38 by the pivot pin 40. For reasons which will be explained below, there must be a relatively small amount of vertical clearance between the lever 38 and the adjacent edge of the sear block 42 to permit limited angular movement of the sear block about the pivot pin 40.

Figure 4:
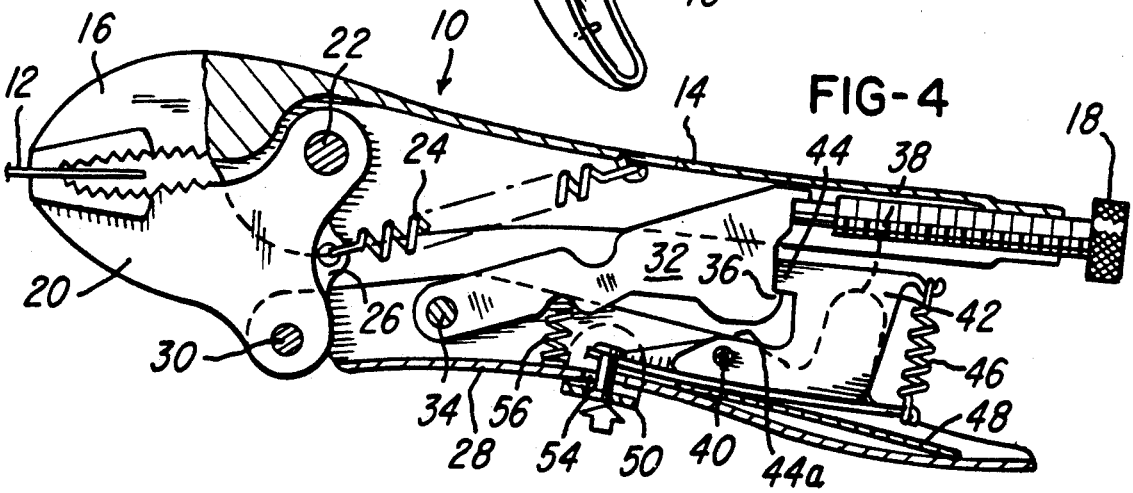
FIG. 4 is comparable to FIG. 2 with the actuating button depressed to increase the tension of the sear spring at the rear portion of the wrench.

As best seen in FIGS. 5 and 6, the sear block 42 has a companion sear element identified as second sear element 44. A tension spring 46 is connected between hooks on the lever 38 and the top of the sear block 42. Unless otherwise restrained as seen in FIG. 4, the tension spring 46 would pivot the sear block 42 clockwise until it bottoms against the lever 38. The second sear element 44 would have been rotated to the position depicted in FIG. 5 and there would be no way that the sear elements 36 and 44 could engage each other as shown, for example, in FIGS. 1 and 2, when the handles of the wrench are squeezed together to grip a workpiece.

An elongated and slightly bowed leaf spring 48 is retained between the actuating handle 28 and the lever 38. The contact area between the leaf spring 48 and the lever 38 is on the same side of the pivot pin 40, for which reason, when the handles are squeezed to close the jaws of the wrench onto a workpiece, the leaf spring will bias the sear element 44 into firm engagement with the sear element 36 on the toggle link 32. After the wrench is latched and the operator's hand pressure is relaxed on the handles of the wrench, the leaf spring will return to its unloaded configuration as depicted in FIG. 2.

A manual release button 50 is attached to the forward end of the lever 38 by means of a rivet 52 passing through a hole 54 in the actuating handle 28. The release button 50 is a saddle button; however, any other type of button and any other convenient attaching means may be used.

Depressing button 50, when the wrench is gripping a workpiece and the wrench is latched, causes the spring 46 end of the lever to rotate downward against the leaf spring 48. Since the sear element 44 on the sear block 42 is engaged with the sear element 36 on the toggle link 32, and since this engagement is under great pressure in countering the gripping pressure of the jaws on the workpiece, the sear block 42 does not pivot with the lever 38. This relative movement between the lever and the sear block increases the tension of the tension spring 46 by stretching the spring.

If the button 50 is now released, the leaf spring 48 will bias the lever back to its initial position relative to the sear block. If however sufficient gripping pressure is applied to the handles of the wrench to sufficiently reduce the pressure holding the sear elements in engagement while simultaneously the release button is held in its depressed position, then the tension spring 46 will disengage the sear. As the user now relaxes his squeeze on the handles, the stored energy in the stressed wrench will be released in a controlled manner.

Since the present invention relates to the type of toggle wrench in which the toggle is intended to stop prior to the toggle dead center line, provision is made to meet this objective.

Reference is now made to FIGS. 2 and 3 in the area of the pivot pin 40. FIG. 2 depicts the wrench gripping a workpiece and with no additional squeezing pressure on the handles. It is noted that there is a gap between that portion of the toggle link 32 and the top edge of the sear block 44 which is indicated by the numeral **44*a* on FIG. 6 only. If additional squeezing pressure is applied to the handles of the wrench, the toggle link cannot move beyond the point where it contacts the sear block as depicted by the closed gap in FIG. 3. The pivot pin 40** will absorb any additional applied force. The pertinent components are designed so that contact between the toggle link and the sear block is made prior to the toggle dead center position to provide an effective stop means which limits travel of the toggle link.

To unlatch a wrench which is gripping a workpiece, the user grips the handles in the usual manner and squeezes the handles while simultaneously depressing the actuating button with the same hand. If the wrench is grasped from one side, the actuating button may be depressed with the forefinger. If the wrench is grasped from the other side thereof, the actuating button may be depressed with the base of the thumb. As squeezing pressure on the handles increases, the pressure holding the sear elements together will decrease. The pressure on the sear elements decreases until a level is reached where the tension spring 46 breaks the sear as indicated in FIG. 5. After the sear is broken to unlatch the wrench, the user relaxes the squeezing pressure on the handles and thereby controls the rate at which the wrench will attain the fully open position as shown in FIG. 6.

The safety plier type toggle wrench of the present invention is safe for any user because it cannot be unlatched without the user putting substantial squeezing pressure on the handles to unlatch it. Even when unlatched, the wrench will not fly open because of the squeezing pressure remaining on the handles. The wrench will not assume its fully open attitude as long as there is any squeezing pressure on the handles.

The purpose of the compression spring 56 which is supported by the actuating handle 28 is to give an initial boost for opening the wrench when it unlatches.

Figure 7:
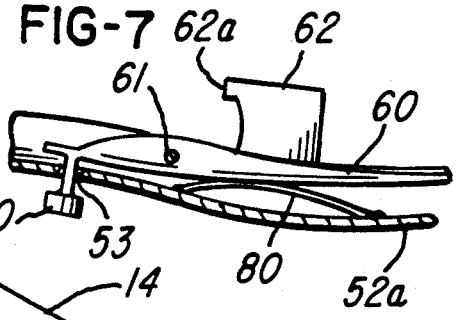
FIG. 7 is a fragmentary cross-sectional elevation depicting changes in a second embodiment of the toggle wrench.

Specific reference is now made to FIG. 7 which is a fragmentary elevation of a variation of the present invention. The principal variation is to mount the sear block directly on the upper side of the actuating lever. All components of the toggle wrench which are not depicted in FIG. 7 remain identical to the previously described components in form and in function.

An actuating lever 60 is pivotally supported by actuating handle **52*a* by means of pivot pin 61. The sear block 62 is joined to the upper face of the actuating lever 60 by welding or by other convenient method. The sear block 62 has a sear element 62*a* which engages the companion sear element on the toggle link. An actuating button 70 has a stem which passes through hole 53 in the actuating handle 52 and is joined to the actuating lever 60 by any convenient method. A bowed leaf spring 80 is disposed between the actuating handle 52*a* and the actuating lever 60. The principal function of the leaf spring 60 is to bias the sear block 62 to cause the sear element 62*a*** to engage the companion sear on the toggle link.

As in the previously described design, the toggle wrench is unlatched by applying sufficient squeezing pressure on the handles while simultaneously depressing the actuating button 70.

Specific reference is now made to FIGS. 8–13 which depict several additional species of the present invention. The toggle wrenches depicted in FIGS. 8–12 have a sear block 91 having a second sear element 92. In the toggle wrenches depicted in FIGS. 8–12, the sear block 91 is slidably nested between two upwardly extending sides of the elongated actuating lever 94 where both the sear block 91 and the lever 94 are pivotally joined to the actuating handle 28 by means of a common pivot pin 93.

Figure 13:
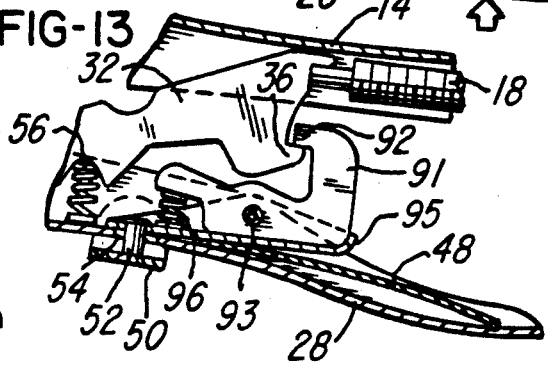

In the toggle wrench depicted in FIG. 13, the sear block 91 is slidably nested between like upwardly extending sides of a shorter actuating lever 95 where both the sear block 91 and actuating lever 95 are pivotally joined to the actuating handle 28 by means of a common pivot pin 93.

In FIGS. 8–12, a compression spring 96 is disposed between the upper side of the actuating lever 94 and a forward extending projection on the sear block 91 to be longitudinally positioned forward of the pivot pin 93. In FIG. 13, the compression spring is disposed in like manner between actuating lever 95 and sear block 91.

As is true in all species of the toggle wrench constituting the present invention, there is a small amount of clearance between the bottom edge of the sear block and the adjacent face of the actuating levers 94 and 95 to permit a degree of relative angular movement between the sear block and the actuating lever.

When the toggle wrench is in its normally free condition, the leaf spring 48, bearing against the actuating lever 94 or 95, will bias the sear block in a counterclockwise direction to latch when the wrench is closed to grip a workpiece. At the same time, the compression spring 96 will be further compressed.

When, however, the release button 50, which is attached to the actuating lever is depressed, only the actuating lever 94 or 95 will have angular movement clockwise on the pivot pin. The sear block remains latched because all the force gripping the workpiece must be counteracted by the latched sear.

When the override is actuated while simultaneously the handles of the wrench are squeezed together, a point is reached where the pressure on the sear is reduced sufficiently to permit the loaded compression spring to unlatch the sear.

A stop, as previously described, is provided to prevent the toggle of the wrench from crossing the dead center position.

Figure 8:
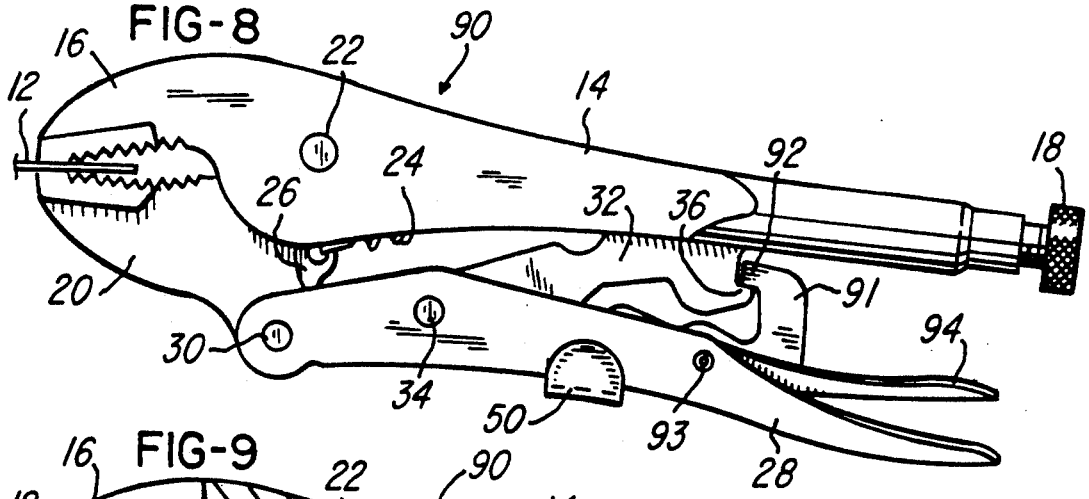
FIG. 8 is a front elevation of another species of the present invention, gripping a workpiece and latched in the gripping mode.
Figure 9:
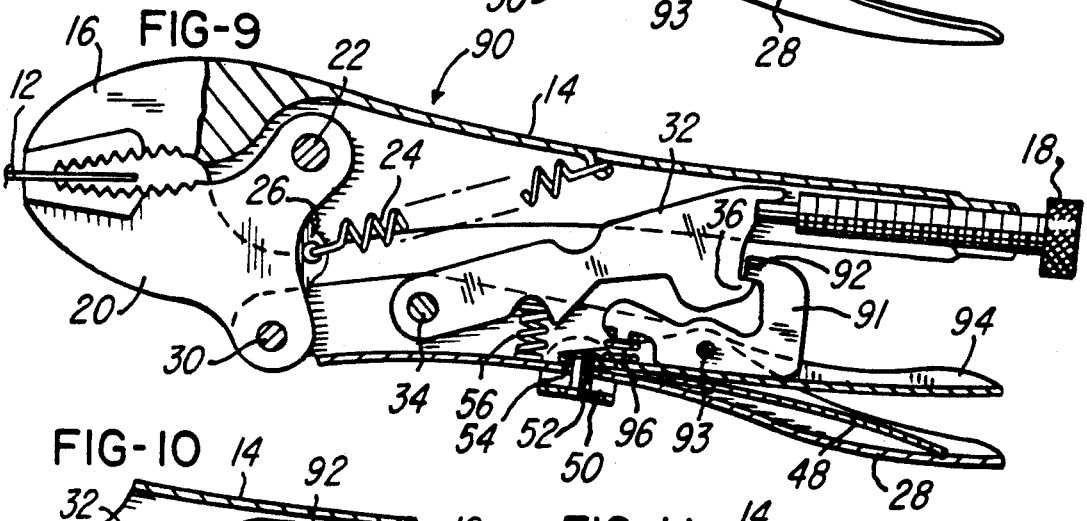
FIG. 9 is comparable to FIG. 8, and partially in section to depict internal elements of the wrench.
Figure 10:
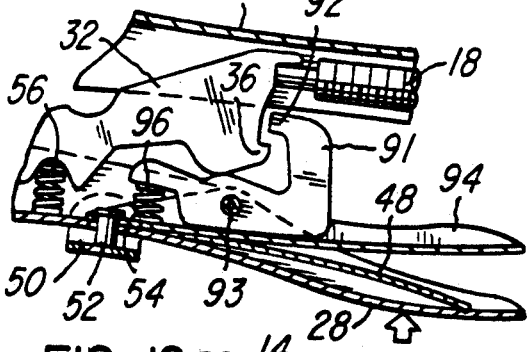
FIG. 10 is a fragmentary elevation comparable to FIG. 9 with the sear in the unlatched position and depicting the stop to limit movement when the handles of the wrench are squeezed.
Figure 11:
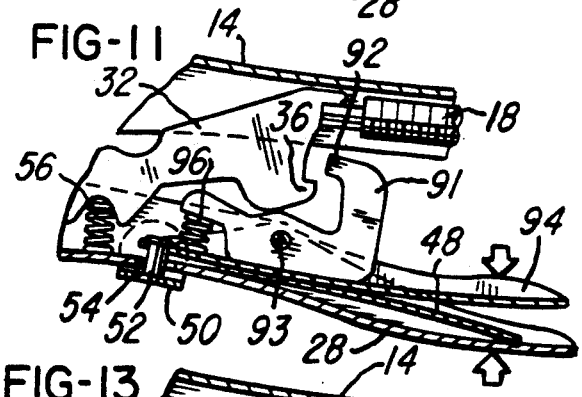
FIG. 11 is a fragmentary elevation comparable to FIG. 10 and depicting the relative position of the latch elements when the extended actuating lever is pushed in the direction of the actuating handle.

FIGS. 8 and 9 depict a toggle wrench having both a push button 50 and an extended actuating lever 94, the end of which extends substantially to the free end of the actuating handle 28. A wrench having this combination may be operated by depressing the push button, or by depressing the free end of the actuating lever toward the actuating handle 28. This combination is also depicted in FIGS. 10 and 11.

Figure 12:
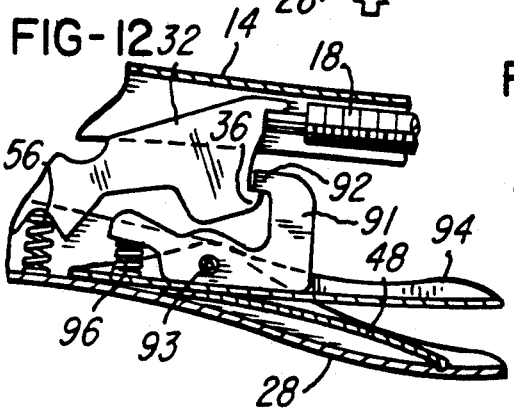
FIG. 12 is a fragmentary elevation comparable to FIG. 10 but without a release button; and, FIG. 13 is a fragmentary elevation comparable to FIG. 10 but without an extended actuating lever.

FIG. 12 depicts a wrench which does not have a push button 50 and is actuated by depressing the extended actuating lever 94.

FIG. 13 depicts a wrench which does not have an extended actuating lever and is actuated by the push button 50.

It is to be understood that the embodiments of the present invention as shown and described are to be regarded as merely illustrative, and that the invention is susceptible to variations, modifications and changes, without regard to specific construction methods within the scope of the appended claims.

I claim:

1. A safety plier type toggle wrench, for one hand manipulation, comprising:

a) an elongated main handle having a fixed first jaw at a first end thereof and an elongated adjusting screw at the second end thereof, the inner end of said adjusting screw terminating in an abutment thereon;

b) a second movable jaw pivotally mounted on said main handle and positioned to cooperate with said first jaw in providing gripping means;

c) a tension spring biasing means having a first end connected to said main handle and a second end thereon connected to said second movable jaw for biasing said second jaw away from said first jaw;

d) an actuating handle having a first end pivotally joined to a protuberance extending from said second jaw, and a second free end thereon;

e) a toggle link having a first end pivotally joined to said actuating handle near the first end thereon, and a second end bearing against the abutment on said adjusting screw, said toggle link further having a first sear element thereon, said adjusting screw controlling the opening between said first and said second jaws when said actuating handle is manipulated; and, f) a latching-unlatching mechanism, said mechanism having an elongated lever having a forward first end and a rear second end; a sear block having a second sear element, said lever and said sear block being pivotally supported by said actuating handle on a common horizontal pivot pin for limited angular movement on said pivot pin; a first spring biasing means disposed between said actuating handle and said latching-unlatching mechanism for biasing said second sear element into latched engagement with said first sear element on said toggle link when said wrench is closed to grip a workpiece; a second biasing means connected to and acting between said sear block and said elongated lever for biasing said second sear element to unlatch from said first sear element on said toggle link; and, a normally-off override engaging the portion of said lever forward of said pivot pin for overriding the biasing action of said first biasing means to thereby permit said second biasing means to unlatch said second sear element from said first sear element on said toggle link when sufficient squeezing pressure is applied to the handles of said wrench with one hand while simultaneously activating said override with said hand.

2. A safety plier type toggle wrench in accordance with claim 1 in which said override is a push button means extending through an aperture in said actuating handle.

3. A safety plier type toggle wrench in accordance with claim 1 in which said means for biasing said second sear element into engagement with said first sear element is a leaf spring disposed between said latching-unlatching mechanism and said actuating handle.

4. A safety plier type toggle wrench in accordance with claim 1 in which a portion of said sear block provides a stop for preventing said toggle link from reaching toggle dead center.

5. A safety plier type toggle wrench, for one hand manipulation, comprising:

a) an elongated main handle having a fixed first jaw at a first end thereof and an elongated adjusting screw at the second end thereof, the inner end of said adjusting screw terminating in an abutment thereon;

b) a second movable jaw pivotally mounted on said main handle and positioned to cooperate with said first jaw in providing gripping means;

c) a tension biasing means having a first end connected to said main handle and a second end thereon connected to said second movable jaw for biasing said second jaw away from said first jaw;

d) an actuating handle having a first end pivotally joined to a protuberance extending from said second jaw, and a second free end thereon;

e) a toggle link having a first end pivotally joined to said actuating handle near the first end thereon, and a second end bearing against the abutment on said adjusting screw, said toggle link further having a first sear element thereon, said adjusting screw controlling the opening between said first and said second jaws when said actuating handle is manipulated; and, f) a latching-unlatching mechanism, said mechanism having an elongated lever having a forward first end and a rear second end; a sear block having a second sear element, said lever having upward extending side elements on opposing sides of said lever for slidably receiving said sear block, said lever and said sear block being pivotally supported by said actuating handle on a common horizontal pivot pin passing through said sear block and the upward extending side elements on said lever intermediate of the forward and rear ends of said lever for limited angular movement on said pivot pin, and with the bottom edge of said sear block and the adjacent top side of said lever having clearance therebetween for limited angular movement between said sear block and said lever; a first spring biasing means disposed between said actuating handle and said latching-unlatching mechanism for biasing said second sear element into latched engagement with said first sear element on said toggle link when said wrench is closed to grip a workpiece; a second spring biasing means connected to and acting between said sear block and said elongated lever for biasing said second sear element to unlatch from said first sear element on said toggle link; and, a normally-off override engaging the portion of said lever forward of said pivot pin for overriding the biasing action of said first biasing means to thereby permit said second biasing means to unlatch from said first sear element on said toggle link when sufficient squeezing pressure is applied to the handles of said wrench with one hand while simultaneously activating said override with said hand.

6. A safety plier type toggle wrench in accordance with claim 5 in which said override is a push button means extending through an aperture in said actuating handle.

7. A safety plier type toggle wrench in accordance with claim 5 in which said means for biasing said second sear element into engagement with said first sear element is a leaf spring disposed between said latching-unlatching mechanism and said actuating handle.

8. A safety plier type toggle wrench in accordance with claim 5 in which a portion of said sear block provides a stop for preventing said toggle link from reaching toggle dead center.

9. A safety plier type toggle wrench, for one hand manipulation, comprising:

a) an elongated main handle having a fixed first jaw at a first end thereof and an elongated adjusting screw at the second end thereof, the inner end of said adjusting screw terminating in an abutment thereon;

b) a second movable jaw pivotally mounted on said main handle and positioned to cooperate with said first jaw in providing gripping means;

c) a tension biasing means having a first end connected to said main handle and a second end thereon connected to said second movable jaw for biasing said second jaw away from said first jaw;

d) an actuating handle having a first end pivotally joined to a protuberance extending from said second jaw, and a second free end thereon;

e) a toggle link having a first end pivotally joined to said actuating handle near the first end thereon, and a second end bearing against the abutment on said adjusting screw, said toggle link further having a first sear element thereon, said adjusting screw controlling the opening between said first and said second jaws when said actuating handle is manipulated; and, f) a latching-unlatching means having an elongated lever having a forward first end and a rear second end, said lever being pivotally joined to said actuating handle on a horizontal pivot pin intermediate to the forward and rear ends of said lever; a sear block having a second sear element, said sear block being joined to the top side of said lever between said pivot pin and the rear end of said lever; a spring biasing means disposed between said actuating handle and said lever for biasing said second sear element into latched engagement with said first sear element on said toggle link when said wrench is closed to grip a workpiece; and, a normally-off override engaging the portion of said lever forward of said pivot pin for overriding the biasing action of said spring biasing means and thereby causing said second sear element to unlatch from said first sear element on said toggle link when sufficient squeezing pressure is applied to the handles of said wrench with one hand while simultaneously actuating said override with said hand.

10. A safety plier type toggle wrench in accordance with claim 9 in which a portion of said sear block provides a stop for preventing said toggle link from reaching toggle dead center.

11. A safety plier type toggle wrench comprising:

a) an elongated main handle having a fixed first jaw at a first end thereof and an elongated adjusting screw at the second end thereof, the inner end of said adjusting screw terminating in an abutment thereon;

b) a second movable jaw pivotally mounted on said main handle and positioned to cooperate with said first jaw in providing gripping means;

c) a tension spring biasing means having a first end connected to said main handle and a second end thereon connected to said second movable jaw for biasing said second jaw away from said first jaw;

d) an actuating handle having a first end pivotally joined to a protuberance extending from said second jaw, and a second free end thereon;

e) a toggle link having a first end pivotally joined to said actuating handle near the first end thereon, and a second end bearing against the abutment on said adjusting screw, said toggle link further having a first sear element thereon, said adjusting screw controlling the opening between said first and said second jaws when said actuating handle is manipulated; and f) a latching-unlatching mechanism, said mechanism having an elongated actuating lever having a forward first end and a rear second end extending rearward to be longitudinally proximate to the free end of said actuating handle of said wrench; a sear block having a second sear element, said lever and said sear block being pivotally supported by said actuating handle on a common horizontal pivot pin for limited angular movement on said pivot pin, and with the bottom edge of said sear block and the adjacent top side of said lever having clearance therebetween for limited relative angular movement between said sear block and said lever; a first spring biasing means disposed between said actuating handle and said latching-unlatching mechanism for biasing said second sear element into latched engagement with said first sear element on said toggle link when said wrench is closed to grip a workpiece; a second spring biasing means disposed between said lever and said sear block to be forward of said pivot pin for biasing said second sear element on said sear block to unlatch from said first sear element on said toggle link; and a normally-off first override connected to the portion of said lever forward of said pivot pin for overriding the biasing action of said first biasing means, said first override being supplemented by and moving with a second override formed by the free rear end of said elongated lever, either of said overrides, when activated, overriding the biasing action of said first spring biasing means to thereby permit said second spring biasing means to unlatch said second sear element from said first sear element on said toggle link when sufficient squeezing pressure is applied to the handles of said wrench with one hand while simultaneously activating one of said overrides.

12. A safety plier type toggle wrench in accordance with claim 11 in which said actuating lever has upwardly extending side elements on opposing sides of said lever for slidably receiving said sear block.

13. A safety plier type toggle wrench in accordance with claim 11 in which said spring biasing means for biasing said second sear element into engagement is an elongated leaf spring.

14. A safety plier type toggle wrench in accordance with claim 11 in which a portion of said sear block provides a stop for preventing said toggle link from reaching toggle dead center.

15. A safety plier type toggle wrench in accordance with claim 11 in which said first override is a push button means extending through an aperture in said actuating handle.

16. A safety plier type toggle wrench comprising:

a) an elongated main handle having a fixed first jaw at a first end thereof and an elongated adjusting screw at the second end thereof, the inner end of said adjusting screw terminating in an abutment thereon;

b) a second movable jaw pivotally mounted on said main handle and positioned to cooperate with said first jaw in providing gripping means;

c) a tension spring biasing means having a first end connected to said main handle and a second end thereon connected to said second movable jaw for biasing said second jaw away from said first jaw;

d) an actuating handle having a first end pivotally joined to a protuberance extending from said second jaw, and a second free end thereon;

e) a toggle link having a first end pivotally joined to said actuating handle near the first end thereon, and a second end bearing against the abutment on said adjusting screw, said toggle link further having a first sear element thereon, said adjusting screw controlling the opening between said first and said second jaws when said actuating handle is manipulated; and, f) a latching-unlatching mechanism, said mechanism having an elongated actuating lever having a forward first end and a rear second end extending rearward to be longitudinally proximate to the free end of said actuating handle of said wrench; a sear block having a second sear element, said lever and said sear block being pivotally supported by said actuating handle on a common horizontal pivot pin for limited angular movement on said pivot pin, and with the bottom edge of said sear block and the adjacent top side of said lever having clearance therebetween for limited relative angular movement between said sear block and said lever; a first spring biasing means disposed between said actuating handle and said latching-unlatching mechanism for biasing said second sear element into latched engagement with said first sear element on said toggle link when said wrench is closed to grip a workpiece; and a second spring biasing means disposed between said lever and said sear block to be forward of said pivot pin for biasing said second sear element on said sear block to unlatch from said first sear element on said toggle link, with the free rear end of said elongated actuating lever forming a normally-off override for overriding the biasing action of said first spring biasing means to thereby permit said second spring biasing means to unlatch said second sear element from said first sear element on said toggle link when sufficient squeezing pressure is applied to the handles of said wrench with one hand while simultaneously depressing the rear free end of said actuating lever toward said actuating handle of said wrench.

17. A safety plier type toggle wrench in accordance with claim 16 in which said actuating lever has upwardly extending side elements on opposing sides of said lever for slidably receiving said sear block.

18. A safety plier type toggle wrench in accordance with claim 16 in which said spring biasing means for biasing said second sear element into latched engagement is an elongated leaf spring.

19. A safety plier type toggle wrench in accordance with claim 16 in which a portion of said sear block provides a stop for preventing said toggle link from reaching toggle dead center.

20. A safety plier type toggle wrench comprising:

a) an elongated main handle having a fixed first jaw at a first end thereof and an elongated adjusting screw at the second end thereof, the inner end of said adjusting screw terminating in an abutment thereon;

b) a second movable jaw pivotally mounted on said main handle and positioned to cooperate with said first jaw in providing gripping means;

c) a tension spring biasing means having a first end connected to said main handle and a second end thereon connected to said second movable jaw for biasing said second jaw away from said first jaw;

d) an actuating handle having a first end pivotally joined to a protuberance extending from said second jaw, and a second free end thereon;

e) a toggle link having a first end pivotally joined to said actuating handle near the first end thereon, and a second end bearing against the abutment on said adjusting screw, said toggle link further having a first sear element thereon, said adjusting screw controlling the opening between said first and said second jaws when said actuating handle is manipulated; and, f) a latching-unlatching mechanism, said mechanism having an elongated lever having a forward first end and a rear second end; a sear block having a second sear element, said lever and said sear block being pivotally supported by said actuating handle on a common horizontal pivot pin for limited angular movement on said pivot pin, and with the bottom edge of said sear block and the adjacent top side of said lever having clearance therebetween for limited relative angular movement between said sear block and said lever; a first spring biasing means disposed between said actuating handle and said latching-unlatching mechanism for biasing said second sear element into latched engagement with said first sear element on said toggle link when said wrench is closed to grip a workpiece; a second spring biasing means disposed between said lever and said sear block to be forward of said pivot pin for biasing said second sear element on said sear block to unlatch from said first sear element on said toggle link; and, a normally-off override engaging the portion of said lever forward of said pivot pin for overriding the biasing action of said first spring biasing means to thereby permit said second spring biasing means to unlatch said second sear element from said first sear element on said toggle link when sufficient squeezing pressure is applied to the handles of said wrench with one hand while simultaneously activating said override.

21. A safety plier type toggle wrench in accordance with claim 20 in which said actuating lever has upwardly extending side elements on opposing sides of said lever for slidably receiving said sear block.

22. A safety plier type toggle wrench in accordance with claim 20 in which said spring biasing means for biasing said second sear element into latched engagement is an elongated leaf spring.

23. A safety plier type toggle wrench in accordance with claim 20 in which a portion of said sear block provides a stop for preventing said toggle link from reaching toggle dead center.

24. A safety plier type toggle wrench in accordance with claim 20 in which said override is a push button means extending through an aperture in said actuating handle.

* * * * *